US009158250B2

(12) United States Patent
Imada et al.

(10) Patent No.: US 9,158,250 B2
(45) Date of Patent: Oct. 13, 2015

(54) FIXING DEVICE AND IMAGE FORMING APPARATUS

(75) Inventors: Takahiro Imada, Kanagawa (JP); Masaaki Yoshikawa, Tokyo (JP); Kenji Ishii, Kanagawa (JP); Hiroshi Yoshinaga, Chiba (JP); Yuji Arai, Kanagawa (JP); Naoki Iwaya, Tokyo (JP); Tetsuo Tokuda, Kanagawa (JP); Hiromasa Takagi, Tokyo (JP); Yoshiki Yamaguchi, Kanagawa (JP); Ippei Fujimoto, Tokyo (JP); Takuya Seshita, Kanagawa (JP); Yutaka Ikebuchi, Kanagawa (JP); Arinobu Yoshiura, Kanagawa (JP); Toshihiko Shimokawa, Kanagawa (JP); Hajime Gotoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 484 days.

(21) Appl. No.: 13/346,093

(22) Filed: Jan. 9, 2012

(65) Prior Publication Data

US 2012/0177423 A1 Jul. 12, 2012

(30) Foreign Application Priority Data

Jan. 11, 2011 (JP) ..... 2011-003341

(51) Int. Cl.
*G03G 15/20* (2006.01)

(52) U.S. Cl.
CPC .... *G03G 15/2064* (2013.01); *G03G 2215/2035* (2013.01)

(58) Field of Classification Search
CPC ..... G03G 2215/2016; G03G 2215/2019; G03G 2215/2022; G03G 2215/2025; G03G 2215/2029; G03G 2215/2032; G03G 2215/2035; G03G 2215/2038; G03G 2215/2041; G03G 2215/2053
USPC ..... 399/328, 329
See application file for complete search history.

(56) References Cited

U.S. PATENT DOCUMENTS 6,628,916 B2 9/2003 Yasui et al.
6,636,709 B2 10/2003 Furukawa et al.

(Continued)

FOREIGN PATENT DOCUMENTS

JP 05241467 A * 9/1993
JP 3582269 B2 8/2004

(Continued)

OTHER PUBLICATIONS

Japanese Office Action dated Jul. 3, 2015 for JP Application No. 2011-003341.

*Primary Examiner* — Walter L Lindsay, Jr.
*Assistant Examiner* — Milton Gonzalez
(74) *Attorney, Agent, or Firm* — Harness, Dickey & Pierce, P.L.C.

(57) ABSTRACT

A fixing device includes: an endless fixing member; a heating unit that is provided inside an inner peripheral surface of the fixing member; and a nip forming unit that comes into press-contact with a rotationally driven pressing member with the fixing member interposed therebetween to form a nip. The nip forming unit has a shape in which a center of a contact surface protrudes toward the pressing member compared to both ends. The nip forming unit has a protruding amount at a center toward the pressing member compared to both ends of the nip forming unit in no-load state is set to be less than a bent amount of the nip forming unit when the nip forming unit comes into press-contact with the pressing member with the fixing member interposed therebetween.

34 Claims, 5 Drawing Sheets

(56) References Cited

U.S. PATENT DOCUMENTS 6,778,790 B2 8/2004 Yoshinaga et al.
6,778,804 B2 8/2004 Yoshinaga et al.
6,785,505 B2 8/2004 Yasui et al.
6,813,464 B2 11/2004 Amita et al.
6,881,927 B2 4/2005 Yoshinaga et al.
6,882,820 B2 4/2005 Shinshi et al.
6,892,044 B2 5/2005 Yasui et al.
6,937,827 B2 8/2005 Katoh et al.
7,022,944 B2 4/2006 Yoshinaga et al.
7,054,570 B2 5/2006 Kishi et al.
7,116,923 B2 10/2006 Kishi et al.
7,127,204 B2 10/2006 Satoh et al.
7,130,555 B2 10/2006 Kishi et al.
7,151,907 B2 12/2006 Yoshinaga
7,209,675 B2 4/2007 Matsusaka et al.
7,212,758 B2 5/2007 Kishi et al.
7,212,759 B2 5/2007 Kishi et al.
7,239,821 B2 7/2007 Matsusaka et al.
7,239,838 B2 7/2007 Sato et al.
7,242,897 B2 7/2007 Satoh et al.
7,308,216 B2 12/2007 Kishi et al.
7,313,353 B2 12/2007 Satoh et al.
7,333,743 B2 2/2008 Kishi et al.
7,343,113 B2 3/2008 Matsusaka et al.
7,352,987 B2 4/2008 Iwata et al.
7,356,270 B2 4/2008 Matsusaka et al.
7,366,432 B2 4/2008 Kishi et al.
7,373,094 B2 5/2008 Kishi et al.
7,379,698 B2 5/2008 Yoshinaga
7,437,111 B2 10/2008 Yamada et al.
7,454,151 B2 11/2008 Satoh et al.
7,466,949 B2 12/2008 Satoh et al.
7,496,309 B2 2/2009 Matsusaka et al.
7,509,085 B2 3/2009 Yoshinaga et al.
7,515,845 B2 4/2009 Kishi et al.
7,546,049 B2 6/2009 Ehara et al.
7,551,869 B2 6/2009 Kishi et al.
7,565,087 B2 7/2009 Matsusaka et al.
7,570,910 B2 8/2009 Ishii
7,603,049 B2 10/2009 Kishi et al.
7,609,988 B2 10/2009 Kishi et al.
7,664,410 B2 2/2010 Takagi
7,702,271 B2 4/2010 Yamada et al.
7,783,240 B2 8/2010 Ito et al.
7,796,933 B2 9/2010 Ueno et al.
7,801,457 B2 9/2010 Seo et al.
7,840,151 B2 11/2010 Fujimoto
7,885,569 B2 2/2011 Kishi et al.
7,912,392 B2 3/2011 Yoshinaga et al.
7,925,177 B2 4/2011 Ishii et al.
7,953,338 B2 5/2011 Takagi
7,957,663 B2 6/2011 Kishi et al.
7,983,598 B2 7/2011 Shinshi et al.
8,005,406 B2 8/2011 Hosokawa et al.
8,023,861 B2 9/2011 Yoshinaga et al.
8,064,798 B2 11/2011 Shinshi et al.
8,073,352 B2 12/2011 Kunii et al.
8,219,016 B2 7/2012 Hasegawa et al.
2002/0018663 A1 2/2002 Furukawa et al.
2002/0067936 A1 6/2002 Yasui et al.
2003/0000933 A1 1/2003 Yoshinaga et al.
2003/0007813 A1 1/2003 Yasui et al.
2003/0016963 A1 1/2003 Yoshinaga et al.
2003/0165348 A1 9/2003 Amita et al.
2003/0206758 A1 11/2003 Yasui et al.
2003/0215271 A1 11/2003 Yoshinaga et al.
2004/0013453 A1 1/2004 Shinshi et al.
2004/0223795 A1* 11/2004 Ono et al. ..... 399/329
2004/0245241 A1 12/2004 Kishi et al.
2004/0247332 A1 12/2004 Kishi et al.
2004/0247334 A1 12/2004 Kishi et al.
2004/0258426 A1 12/2004 Kishi et al.
2005/0025539 A1 2/2005 Yoshinaga
2005/0074251 A1 4/2005 Katoh et al.
2005/0095043 A1 5/2005 Yoshinaga et al.
2005/0123315 A1 6/2005 Kishi et al.
2005/0139584 A1 6/2005 Kishi et al.
2005/0163543 A1 7/2005 Satoh et al.
2005/0175368 A1 8/2005 Matsusaka et al.
2005/0175370 A1 8/2005 Matsusaka et al.
2005/0180786 A1 8/2005 Yamada et al.
2005/0191078 A1 9/2005 Kishi et al.
2006/0029411 A1 2/2006 Ishii et al.
2006/0039713 A1 2/2006 Kishi et al.
2006/0051111 A1 3/2006 Kishi et al.
2006/0051112 A1 3/2006 Matsusaka et al.
2006/0051113 A1 3/2006 Kishi et al.
2006/0051119 A1 3/2006 Kishi et al.
2006/0051120 A1 3/2006 Kishi et al.
2006/0051121 A1 3/2006 Matsusaka et al.
2006/0116230 A1 6/2006 Satoh et al.
2006/0127118 A1 6/2006 Kishi et al.
2006/0165429 A1 7/2006 Satoh et al.
2006/0165443 A1 7/2006 Yoshinaga et al.
2006/0165448 A1 7/2006 Yoshinaga
2006/0182460 A1 8/2006 Kishi et al.
2006/0257183 A1 11/2006 Ehara et al.
2006/0285893 A1 12/2006 Ishii
2007/0014600 A1 1/2007 Ishii et al.
2007/0014603 A1 1/2007 Satoh et al.
2007/0025754 A1 2/2007 Takagi
2007/0031159 A1 2/2007 Kishi et al.
2007/0212090 A1 9/2007 Matsusaka et al.
2008/0063443 A1 3/2008 Yoshinaga et al.
2008/0124146 A1* 5/2008 Bae et al. ..... 399/329
2008/0145088 A1 6/2008 Matsusaka et al.
2008/0219721 A1 9/2008 Ito et al.
2008/0226326 A1 9/2008 Seo et al.
2008/0232873 A1 9/2008 Ueno et al.
2008/0253789 A1 10/2008 Yoshinaga et al.
2008/0317532 A1 12/2008 Ehara et al.
2009/0003867 A1 1/2009 Fujimoto
2009/0010687 A1 1/2009 Yamada et al.
2009/0067902 A1 3/2009 Yoshinaga et al.
2009/0123172 A1 5/2009 Kishi et al.
2009/0123201 A1 5/2009 Ehara et al.
2009/0123202 A1 5/2009 Yoshinaga et al.
2009/0148204 A1 6/2009 Yoshinaga et al.
2009/0169232 A1 7/2009 Kunii et al.
2009/0245865 A1 10/2009 Shinshi et al.
2009/0317113 A1 12/2009 Kishi et al.
2010/0074667 A1 3/2010 Ehara et al.
2010/0092220 A1 4/2010 Hasegawa et al.
2010/0092221 A1 4/2010 Shinshi et al.
2010/0202809 A1 8/2010 Shinshi et al.
2010/0290822 A1 11/2010 Hasegawa et al.
2010/0303521 A1 12/2010 Ogawa et al.
2011/0026973 A1 2/2011 Hosokawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064451 A1 3/2011 Yamaguchi et al.
2011/0064490 A1 3/2011 Imada et al.
2011/0064502 A1 3/2011 Hase et al.
2011/0076071 A1 3/2011 Yamaguchi et al.
2011/0085815 A1 4/2011 Kishi et al.
2011/0085832 A1 4/2011 Hasegawa et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176820 A1 7/2011 Kadota et al.

(56) References Cited

U.S. PATENT DOCUMENTS

| | | | |
|---|---|---|---|
| 2011/0176822 | A1 | 7/2011 | Ishii et al. |
| 2011/0182634 | A1 | 7/2011 | Ishigaya et al. |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206427 | A1 | 8/2011 | Iwaya et al. |
| 2011/0211876 | A1 | 9/2011 | Iwaya et al. |
| 2011/0217056 | A1 | 9/2011 | Yoshinaga et al. |
| 2011/0217057 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0217101 | A1 | 9/2011 | Okamoto et al. |
| 2011/0222875 | A1 | 9/2011 | Imada et al. |
| 2011/0222888 | A1 | 9/2011 | Ikebuchi et al. |
| 2011/0222926 | A1 | 9/2011 | Ueno et al. |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0222938 | A1 | 9/2011 | Watanabe et al. |
| 2011/0229178 | A1 | 9/2011 | Ogawa et al. |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0274453 | A1 | 11/2011 | Shimokawa et al. |
| 2011/0286758 | A1 | 11/2011 | Yoshinaga |
| 2012/0051774 | A1 | 3/2012 | Ikebuchi et al. |
| 2012/0114345 | A1 | 5/2012 | Fujimoto et al. |
| 2012/0121304 | A1 | 5/2012 | Tokuda et al. |
| 2012/0121305 | A1 | 5/2012 | Yoshikawa et al. |

FOREIGN PATENT DOCUMENTS

| | | | | |
|---|---|---|---|---|
| JP | 2006058410 | A | * | 3/2006 |
| JP | 2007011192 | A | * | 1/2007 |
| JP | 2007322486 | A | | 12/2007 |
| JP | 2009003410 | A | | 1/2009 |
| JP | 2010096782 | A | | 4/2010 |
| JP | 2010286815 | A | | 12/2010 |

* cited by examiner

FIXING DEVICE AND IMAGE FORMING APPARATUS

CROSS-REFERENCE TO RELATED APPLICATIONS

The present application claims priority to and incorporates by reference the entire contents of Japanese Patent Application No. 2011-003341 filed in Japan on Jan. 11, 2011.

BACKGROUND OF THE INVENTION

1. Field of the Invention

The present invention relates to a fixing device and an image forming apparatus.

2. Description of the Related Art

Japanese Patent Application Laid-open No. 2010-096782 discloses a fixing device including a heating unit. The heating unit includes a pipe-like metallic heat conductor disposed so as to face an inner peripheral surface of a fixing belt serving as a fixing member, and a heater which heats the metallic heat conductor. The heating unit heats the entirety of the fixing belt through the heating of the metallic heat conductor. Further, the fixing device disclosed in Japanese Patent Application Laid-open No. 2010-096782 includes a nip forming unit which is disposed near the inner peripheral surface of the fixing belt and comes into press-contact with a pressing roller serving as a rotationally driven pressing member with the fixing belt interposed therebetween so as to form a fixing nip. The driving force is transmitted to the fixing belt by the friction against the pressing roller, so that the fixing belt slides on the outer peripheral surface of the metallic heat conductor.

Since both ends of the nip forming unit in the width direction of a recording sheet (hereinafter, referred to as a main-scanning direction) are fixed and supported by the side plates of the fixing device, the center of the nip forming unit in the main-scanning direction may be largely bent in a direction in which the center moves away from the pressing roller due to the pressure which is applied from the pressing roller. As a result, both ends in the main-scanning direction of a contact surface of the nip forming unit, which comes into contact with the pressing roller with the fixing belt interposed therebetween, protrude outward and the center is pulled inward, thereby causing a phenomenon in which a nip width formed by the pressing roller and the nip forming unit is largely narrowed at the center compared to at the end in the main-scanning direction. As a result, there is a problem in that unevenness of an image occurs at the center and at the end in the main-scanning direction or a conveying failure occurs.

For this reason, in the fixing device disclosed in Japanese Patent Application Laid-open No. 2010-096782, the nip forming unit is formed so that the center of the contact surface of the nip forming unit in the main-scanning direction protrudes toward the pressing roller in relation to both ends in the main-scanning direction in no-load state. As a result, when the nip forming unit is bent, the contact surface of the nip forming unit becomes flat. That is, in this related art, the center of the contact surface of the nip forming unit in the main-scanning direction protrudes toward the pressing roller by a bent amount. Accordingly, when the nip forming unit is bent by the pressure of the pressing roller, the contact surface of the nip forming unit may be made to be flat, and a deviation between the end and the center in the main-scanning direction may be solved.

However, in the fixing device disclosed in Japanese Patent Application Laid-open No. 2010-096782, a problem is found in which a defective image is obtained or a conveying failure occurs depending on the type of a sheet which is conveyed to the fixing nip, for example, a recording sheet having a smooth surface. The inventors could find out the following result by carefully studying the problem. That is, in a case where the recording sheet is conveyed to the fixing nip, a sheet passing portion which comes into contact with the recording sheet at the center of the fixing belt in the main-scanning direction comes into contact with the surface of the recording sheet, and the rotational driving force of the pressing roller is transmitted to the sheet passing portion with the recording sheet interposed therebetween. However, in the recording sheet having a smooth surface, the friction between the recording sheet and the pressing roller or the friction between the recording sheet and the fixing belt decreases, so that the rotational driving force which is transmitted from the pressing roller to the fixing belt decreases. Further, in non-sheet passing portions at both ends which directly come into contact with the pressing roller in the main-scanning direction, the contact pressure decreases due to the thickness of the recording sheet. Accordingly, a sufficient friction may not be obtained even from the non-sheet passing portions, so that the rotational driving force which is transmitted from the pressing roller to the fixing belt decreases. As a result, it has been found that the driving force which is transmitted from the pressing roller to the fixing belt decreases, and the sliding resistance against the outer peripheral surface of the metallic heat conductor increases, so that the fixing belt slips producing the unevenness of the image or the fixing belt stops its rotation causing a conveying failure of the recording sheet.

SUMMARY OF THE INVENTION

It is an object of the present invention to at least partially solve the problems in the conventional technology.

According to an embodiment, a fixing device includes: an endless fixing member; a heating unit that is provided inside an inner peripheral surface of the fixing member that heats the fixing member; and a nip forming unit that comes into press-contact with a rotationally driven pressing member with the fixing member interposed therebetween so as to form a nip to which a recording sheet is conveyed. Both ends of the nip forming unit in a recording sheet width direction are fixed and supported. The nip forming unit has a shape in which a center of a contact surface, coming into contact with the pressing member with the fixing member interposed therebetween in the recording sheet width direction, protrudes toward the pressing member compared to both ends in the recording sheet width direction in no-load state, wherein a toner image on the recording sheet conveyed to the nip is fixed to the recording sheet. The nip forming unit has a protruding amount at a center, in the recording sheet width direction, of the contact surface of the nip forming unit toward the pressing member compared to both ends of the nip forming unit in no-load state is set to be less than a bent amount of the nip forming unit when the nip forming unit comes into press-contact with the pressing member with the fixing member interposed therebetween.

According to another embodiment, an image forming apparatus includes: a toner image forming unit that forms a toner image on a recording sheet; and a fixing unit that fixes an unfixed toner image formed on the recording sheet onto a recording member. The fixing device mentioned above is used as the fixing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
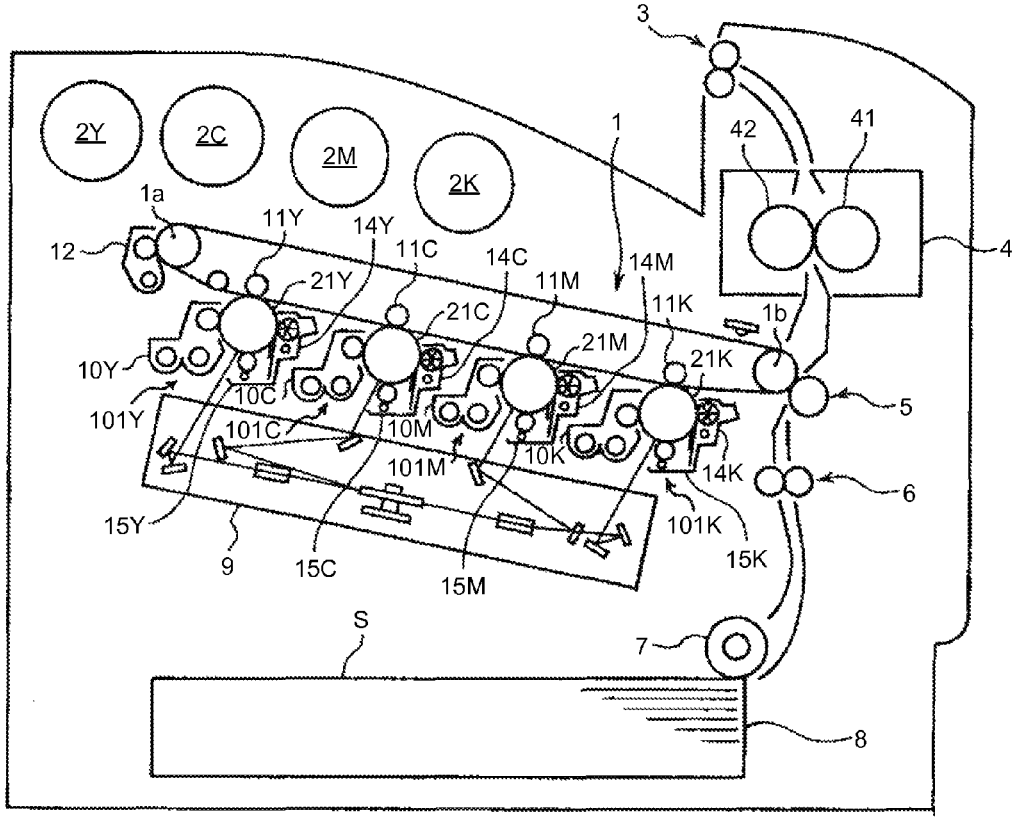
FIG. 1 is a schematic configuration diagram illustrating an image forming apparatus according to an embodiment.

Hereinafter, an embodiment will be described by referring to the drawings.

FIG. 1 is a schematic configuration diagram illustrating an image forming apparatus according to the embodiment. As illustrated in FIG. 1, the image forming apparatus has a configuration in which an image forming apparatus body accommodates an intermediate transfer belt 1 which is an intermediate transfer member serving as an image carrier used to form a color toner image of plural colors, yellow (Y), cyan (C), magenta (M), and black (K) thereon and toner bottles 2Y, 2C, 2M, and 2K which replenish toner of respective colors for the color toner image. The intermediate transfer belt 1 is rotatably suspended on a suspending roller 1*a*, an intermediate transfer belt driving roller 1*b*, or the like. Accordingly, when the intermediate transfer belt driving roller 1*b* rotates in the counter-clockwise direction of the drawing, the intermediate transfer belt 1 also rotates in the counter-clockwise direction of the drawing.

Further, the image forming apparatus has a configuration as below. A recording sheet S which is stacked and accommodated in a paper feed tray 8 provided at the lower portion of the image forming apparatus body is conveyed to a secondary transfer position where the recording sheet faces the intermediate transfer belt 1 at a predetermined timing, the color toner image which is formed on the intermediate transfer belt 1 is transferred onto the recording sheet S, the color toner image which is transferred onto the recording sheet S is fixed, and then the fixed recording sheet S is discharged from the upper portion of the image forming apparatus body. That is, the image forming apparatus includes the following constituents which are arranged from the lower portion of the image forming apparatus to the upper portion thereof. Here, a feed roller 7 which feeds one recording sheet is disposed. A pair of registration rollers 6 which ensures a conveying timing for transferring a toner image is disposed. A secondary transfer roller 5 which faces the intermediate transfer belt driving roller 1*b* so as to come into contact with the intermediate transfer belt 1 and forms a secondary transfer nip with a predetermined pressure ensured between the intermediate transfer belt 1 and the secondary transfer roller is disposed. A fixing device 4 which performs a predetermined heating and pressing operation is disposed. A pair of ejecting rollers 3 which discharges the recording sheet S to the outside of the apparatus is disposed. During a time when the recording sheet S is conveyed through a sheet conveying path which is formed by rollers, the following operations are sequentially performed so that the toner image is transferred from the intermediate transfer belt 1 onto the recording sheet S by the secondary transfer nip and the toner image which is transferred onto the recording sheet S is fixed by the fixing device 4.

Process cartridges 101Y, 101C, 101M, and 101K are formed as four color image forming units which serve as image stations. Then, the process cartridges are in charge of respective colors for forming a color image and form the toner images of the respective colors. These process cartridges are arranged in the longitudinal direction of the intermediate transfer belt 1 which is disposed at a slant in the oblique left-up direction of the drawing. The respective image stations formed as these process cartridges 101Y, 101C, 101M, and 101K respectively include photosensitive elements 21Y, 21C, 21M, and 21K which serve as image carriers.

Further, the respective photosensitive elements 21Y, 21C, 21M, and 21K come into contact with primary transfer rollers 11Y, 11C, 11M, and 11K with the intermediate transfer belt 1 interposed therebetween by ensuring a predetermined pressure therebetween. Charging devices 15Y, 15C, 15M, and 15K, developing devices 10Y, 10C, 10M, and 10K which serve as developing units, and photosensitive cleaning devices 14Y, 14C, 14M, and 14K which serve as cleaning units used for cleaning the photosensitive elements are provided around the photosensitive elements 21Y, 21C, 21M, and 21K.

A writing unit 9 which writes an electrostatic latent image on the surfaces of the respective photosensitive elements 21Y, 21C, 21M, and 21K through the exposure using a predetermined laser beam is disposed below the process cartridges 101Y, 101C, 101M, and 101K.

Further, a belt cleaning device 12, which serves as a cleaning unit used to collect residual toner on the intermediate transfer belt 1 so that the surface of the intermediate transfer belt is cleaned, is provided near one end of the intermediate transfer belt 1 in the longitudinal direction so as to face the suspending roller 1*a* with the intermediate transfer belt 1 interposed therebetween.

Plural toner bottles 2Y, 2C, 2M, and 2K which supply toner to the developing devices 10Y, 10C, 10M, and 10K are sequentially arranged from the left to the right of the drawing in the upper portion inside the apparatus, and are removably provided in the image forming apparatus body so as to be replaced later. Yellow toner, cyan toner, magenta toner, and black toner are respectively charged in the plural toner bottles 2Y, 2C, 2M, and 2K. The toner bottles 2Y, 2C, 2M, and 2K are respectively connected to the developing devices 10Y, 10C, 10M, and 10K of respective colors corresponding to the respective toner bottles 2Y, 2C, 2M, and 2K so that the toner can be supplied from the respective toner bottles to the respective developing devices through a conveying path (not illustrated), and the toner of respective colors is supplied thereto by a predetermined amount.

In the image forming apparatus with such a configuration, when the recording sheet S is fed to the feed roller 7 and the front end of the recording sheet reaches the pair of registration rollers 6, the front end of the recording sheet S is detected by a sensor (not illustrated). Then, the recording sheet S is conveyed by the pair of registration rollers 6 to the nip which is formed between the secondary transfer roller 5 and the intermediate transfer belt 1 at a synchronized timing based on the detecting signal, so that an image which is formed on the intermediate transfer belt 1 is secondarily transferred from the intermediate transfer belt 1 onto the recording sheet S.

The photosensitive elements 21Y, 21C, 21M, and 21K are evenly charged by the charging devices 15Y, 15C, 15M, and 15K in advance, and are scanned by a laser beam based on image data in the writing unit 9, so that electrostatic latent images are formed on the photosensitive elements 21Y, 21C, 21M, and 21K. The respective electrostatic latent images are respectively developed by the developing devices 10Y, 10C, 10M, and 10K of respective colors, so that toner images of yellow, cyan, magenta, and black are formed on the surfaces of the photosensitive elements 21Y, 21C, 21M, and 21K. Then, a voltage is applied to the primary transfer rollers 11Y, 11C, 11M, and 11K, so that toner on the respective photosensitive elements 21Y, 21C, 21M, and 21K is sequentially transferred onto the intermediate transfer belt 1. At this time, the image forming operations of respective colors are performed at different timings from the upstream toward the downstream in the advancing direction of the intermediate transfer belt 1 so that the toner images are transferred to the same position of the intermediate transfer belt 1 so as to be superimposed to each other. The toner image which is formed on the intermediate transfer belt 1 is conveyed to the secondary transfer position where the toner image faces the secondary transfer roller 5, so that the toner image is secondarily transferred onto the recording sheet S. The recording sheet S onto which the color toner image of respective colors is transferred is conveyed to the fixing device 4 so that the toner image is fixed thereto by pressure and heat generated in the fixing device, and the recording sheet is discharged by the pair of ejecting rollers 3.

Figure 2:
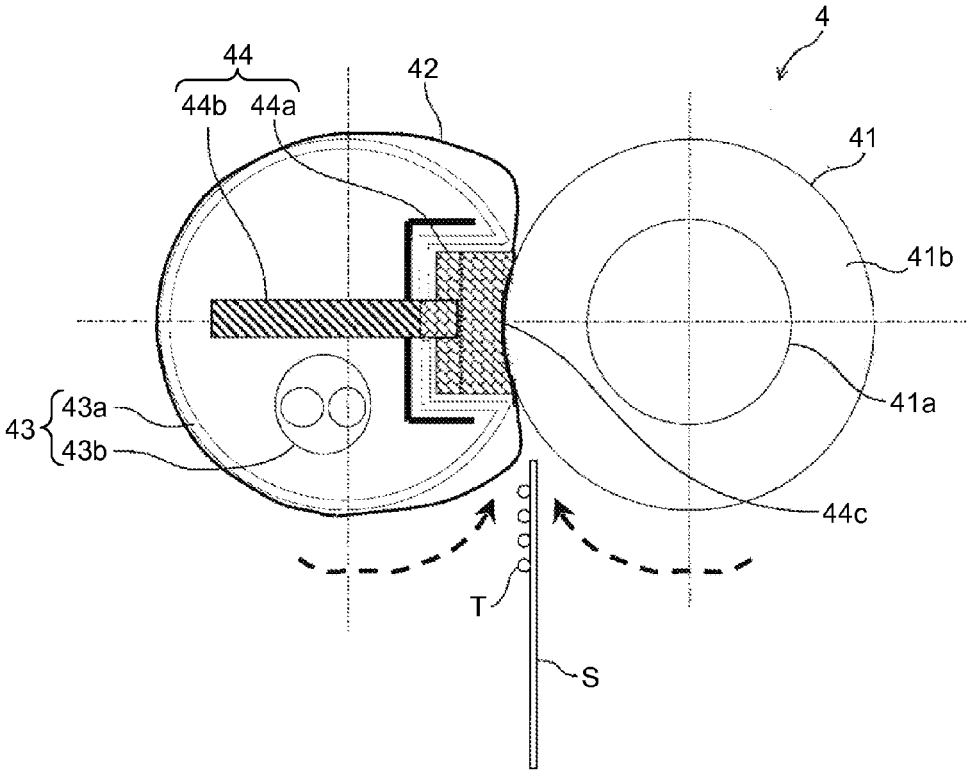
FIG. 2 is a schematic configuration diagram illustrating a fixing device according to the embodiment.

FIG. 2 is an enlarged diagram illustrating the fixing device 4.

The fixing device 4 includes therein a pressing roller 41 which is a pressing member configured to be rotationally driven, a fixing belt 42 which is an endless fixing member, or the like. Further, the fixing belt 42 includes therein a heating unit 43 and a nip forming unit 44.

The heating unit 43 includes a metallic pipe 43*a* and a heater 43*b* which serves as a heating source used for heating the metallic pipe 43*a*. The metallic pipe 43*a* is formed of nickel or stainless steel (SUS), and fluorinated lubricant is coated on the outer peripheral surface which comes into contact with the fixing belt 42. The metallic pipe 43*a* is formed so as to directly face the inner peripheral surface of the fixing belt 42 at a position where the fixing nip is eliminated, and is provided with a concave portion which is formed at the position of the fixing nip so as to be depressed inward and have an opening portion. Then, a contact member 44*a* of the nip forming unit is provided by being inserted into the concave portion of the metallic pipe 43*a* with a clearance therebetween, and a supporting stay 44*b* of the nip forming unit 44 is provided by being inserted into the opening portion. Both ends of the metallic pipe 43*a* are fixed and supported to the side plates of the fixing device 4.

The heater 43*b* (the heating source) is formed as a halogen heater or a carbon heater, and both ends thereof are fixed to the side plates of the fixing device 4. Then, the metallic pipe 43*a* is heated by radiation heat that is generated by the heater 43*b* of which the output is controlled by the power supply unit of the apparatus body. Furthermore, the fixing belt 42 is heated at the entire position except for the nip portion by the metallic pipe 43*a*, and heat is applied from the surface of the heated fixing belt 42 to the toner image T on the recording sheet S. Furthermore, the output of the heater 43*b* is controlled based on the temperature detection result of the surface of the belt that is obtained by a temperature sensor (not illustrated) such as a thermistor which faces the surface of the fixing belt 42. Further, the temperature (the fixing temperature) of the fixing belt 42 may be set to a desired temperature through the control of the output from the heater 43*b*.

With regard to the fixing device 4 of the embodiment, only a part of the fixing belt 42 is not locally heated, but almost the entire part of the fixing belt 42 is heated in the circumferential direction by the metallic pipe 43*a*. Accordingly, even when the fixing device is operated at a high speed, the fixing belt 42 may be sufficiently heated, and occurrence of a fixing failure may be suppressed. Further, in the embodiment, since the heating unit 43 may effectively heat the fixing belt 42 with a comparatively simple configuration such as the metallic pipe 43*a* and the heater 43*b*, a warming-up time or a first printing time may be shortened and the fixing device may be decreased in size.

The fixing belt 42 may be a metallic belt such as nickel or stainless steel (SUS), an endless belt formed of a resin material such as polyimide, or a film. The surface layer of the fixing belt 42 is provided with a separation layer such as a PFA layer or a PTFE layer, so that the surface layer has a separating property of preventing toner from adhering thereto. Further, it is desirable that the fixing belt 42 come into contact with the outer peripheral surface of the metallic pipe 43*a* with almost no gap formed therebetween. Accordingly, the area where the metallic pipe 43*a* slides on the fixing belt 42 increases, which may suppress a problem in which the abrasion of the fixing belt 42 is accelerated. Further, the above-described configuration may suppress a problem in which the metallic pipe 43*a* and the fixing belt 42 are separated from each other too much so that the heating efficiency of the fixing belt 42 is degraded. Furthermore, since the metallic pipe 43*a* is provided near the fixing belt 42, the circular posture of the flexible fixing belt 42 is maintained to a certain degree, so that the degradation and the damage of the fixing belt 42 due to the deformation thereof may be reduced.

Further, in order to reduce the sliding resistance between the outer peripheral surface of the metallic pipe 43*a* and the inner peripheral surface of the fixing belt 42, a back surface layer which is formed of material containing fluorine may be formed on the inner peripheral surface of the fixing belt 42. Furthermore, in the embodiment, the cross-sectional shape of the metallic pipe 43*a* is a substantially circular shape, but the cross-sectional shape of the metallic pipe 43*a* may be a polygonal shape.

The nip forming unit includes the supporting stay 44*b* which serves as a supporting member supported by the fixing device 4 and the contact member 44*a* which comes into contact with the pressing roller 41 with the fixing belt 42 interposed therebetween. The supporting stay 44*b* is used to rigidly support the contact member 44*a* which forms the nip portion, and is fixed to a position near the inner peripheral surface of the fixing belt 42. The supporting stay 44*b* is formed so that the length thereof in the width direction of the recording sheet S (hereinafter, referred to as a main-scanning direction) is equal to the length of the contact member 44*a*, and both ends thereof in the main-scanning direction are fixed and supported to the side plates of the fixing device 4. It is desirable that the supporting stay 44*b* be formed of a metal material such as stainless steel or iron with high mechanical strength in order to satisfy the above-described function. Further, a heat insulating member may be provided on or a BA process or a mirror finishing process may be performed on a part or the entirety of the surface of the supporting stay 44*b* which faces the heater 43*b*. Accordingly, since the heat which is transmitted from the heater 43*b* to the supporting stay 44*b* (the heat which heats the supporting stay 44*b*) is used to heat the metallic pipe 43*a*, the heating efficiency of the fixing belt 42 (the metallic pipe 43*a*) may be further improved.

The contact member 44*a* is formed by wrapping fluorine rubber or heat-resistant resin, for example, liquid crystal polymer using a lubricant sheet such as a PTEF sheet. A contact surface 44*c* of the contact member 44*a* which comes into contact with the pressing roller 41 with the fixing belt 42 interposed therebetween is formed in a concave shape in the axial direction so as to follow the curvature of the pressing roller 41. Accordingly, since the recording sheet S is sent from the fixing nip so as to follow the curvature of the pressing roller 41, a problem in which the recording sheet S subjected to the fixing process is inseparably absorbed to the fixing belt 42 can be suppressed. Further, the shape of the contact member 44*a* in the axial direction may be a planar shape. With such a configuration, the shape of the fixing nip is substantially parallel to the image surface of the recording sheet S, the adhesiveness between the fixing belt 42 and the recording sheet S improves, and the fixing performance thereof improves. Furthermore, since the curvature of the fixing belt 42 at the exit of the fixing nip increases, the recording sheet S which exits the fixing nip may be easily separated from the fixing belt 42. Further, in a case where the contact member 44*a* is formed as an elastic member such as fluorine rubber, the contact member may follow the minute unevenness of the toner image of the recording sheet S which is conveyed to the fixing nip, thereby obtaining a satisfactory fixed image. Further, since the contact member is wrapped by the lubricant sheet, the sliding resistance between the contact member 44*a* and the fixing belt 42 is reduced.

The pressing roller 41 is formed in a manner such that an elastic layer 41*b* formed as a silicon rubber layer is made to adhere to the surface of the metallic roller which is a cored bar 41*a*, and the separation layer (a PFA layer or a PTFE layer) is formed on the outer surface of the elastic layer 41*b* in order to obtain a separating property.

Further, the pressing roller 41 is pressed against the fixing belt 42 by a spring (not illustrated) or the like, and when the pressing roller 41 and the fixing belt 42 come into press-contact with each other so that the contact member 44*a* is pressed and deformed, a predetermined nip width is obtained at the fixing nip.

The pressing roller 41 is configured to rotate by a driving force that is transmitted from a driving device including a motor, a driving roller, and the like which are not illustrated in the drawings and are provided in the image forming apparatus, and when the driving device is controlled by a control unit including a CPU, a memory, and the like provided in the image forming apparatus body, a process linear speed which is a rotating speed of the pressing roller 41 may be arbitrarily changed at a predetermined timing.

The fixing belt 42 rotates by being interlocked to an external roller. In the embodiment, the pressing roller 41 rotates by the driving device, and the driving force is transmitted from the pressing roller 41 to the fixing belt 42 at the fixing nip, so that the fixing belt 42 rotates.

Figure 3:
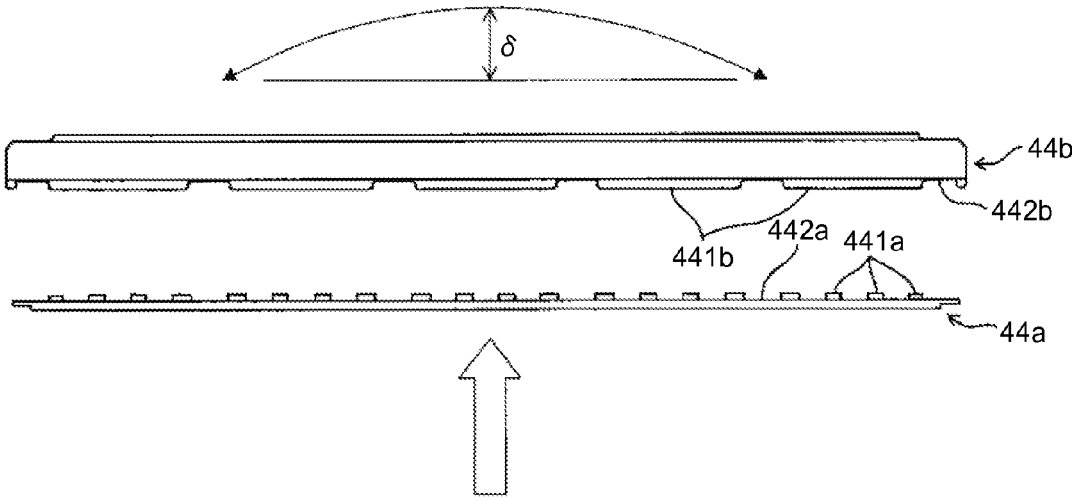
FIG. 3 is a diagram illustrating a contact member and a supporting stay when viewed in the recording sheet conveying direction.

FIG. 3 is a diagram illustrating the contact member 44*a* and the supporting stay 44*b* in the recording sheet conveying direction. A stay facing surface 442*a* of the contact member 44*a* which faces the supporting stay 44*b* is provided with plural fixing portions 441*a* which are provided in the main-scanning direction so as to be fixed to the supporting stay 44*b* (through a lubricant sheet not illustrated). Further, a facing surface 442*b* of the supporting stay 44*b* which faces the contact member 44*a* is provided with plural subject fixing portions 441*b* which are provided in the main-scanning direction so as to protrude from the facing surface 442*b* where the plural fixing portions 441*a* of the contact member 44*a* are fixed (through the lubricant sheet not illustrated).

As described above, the supporting stay 44*b* is a plate-like member which is formed of stainless steel, and both ends thereof in the main-scanning direction are fixed to the side plates of the fixing device 4. With regard to the supporting stay 44*b*, the transverse center which receives a pressure from the pressing roller 41 and is not supported and fixed is bent (by a bent amount: δ) in a direction moving away from the pressing roller 41 due to the pressure of the pressing roller 41. Due to the bending of the supporting stay 44*b*, the transverse center of the contact member 44*a* which is fixed to the supporting stay 44*b* is also bent by the same bent amount δ in a direction moving away from the pressing roller 41. That is, the center of the nip forming unit 44 is largely bent in a direction moving away from the pressing roller due to the pressure of the pressing roller 41. As a result of the large bending of the nip forming unit 44, the center in the main-scanning direction of the contact surface of the nip forming unit 44 (the contact surface of the contact member 44*a*) which comes into contact with the pressing roller with the fixing belt 42 interposed therebetween largely moves away from the pressing roller. Accordingly, the nip width at the center of the fixing nip in the main-scanning direction is largely shortened compared to the nip width at the end thereof. As a result, there is concern in that the image may be uneven between the center and the end and a conveying failure may occur.

Therefore, in the fixing device disclosed in Japanese Patent Application Laid-open No. 2010-096782, the center of the subject fixing portion 441*b* of the supporting stay 44*b* in the main-scanning direction protrudes further toward the pressing roller by the bent amount δ than the end of the subject fixing portion 441*b* in no-load state. Accordingly, when the nip forming unit 44 is bent by the pressure of the pressing roller 41, the contact surface of the nip forming unit 44 (the contact surface of the contact member 44*a*) which comes into contact with the pressing roller with the fixing belt 42 interposed therebetween may have a flat shape in a direction in which the recording sheet S is conveyed. Accordingly, a deviation in nip width between the end and the center in the main-scanning direction may be improved.

However, in the fixing device 4 disclosed in Japanese Patent Application Laid-open No. 2010-096782, when the recording sheet S having a smooth surface is conveyed to the nip portion, the fixing belt 42 may slip, so that the image on the recording sheet may have a defect or the rotation of the fixing belt 42 may stop, which may cause a conveying failure. Specifically, in the sheet passing portion of the fixing belt 42 through which the recording sheet S is conveyed, the rotational driving force is transmitted from the pressing roller 41 to the sheet passing portion with the recording sheet S interposed therebetween. However, in a case where the surface of the recording sheet S which is conveyed to the fixing nip is smooth, the friction between the fixing belt 42 and the recording sheet S and the friction between the recording sheet S and the pressing roller 41 reduce. For this reason, a sufficient driving force is not transmitted from the pressing roller 41 to the sheet passing portion of the fixing belt 42. On the other hand, in the non-sheet passing portion of the fixing belt 42 through which the recording sheet S does not passes, the nip pressure decreases due to the thickness of the sheet which is conveyed to the fixing nip. Accordingly, even in the non-sheet passing portion, a sufficient friction may not be obtained, and hence a sufficient rotational driving force is not transmitted from the pressing roller 41 thereto. As a result, the sliding resistance of the fixing belt against the metallic pipe 43*a* becomes larger than the driving force which is transmitted from the pressing roller 41, so that the fixing belt 42 slips or the rotation of the fixing belt stops.

Therefore, in the embodiment, the protruding amount, in which the center and both ends of the nip forming unit 44 in the main-scanning direction protrude toward the pressing roller in no-load state, is set to be less than the bent amount of the nip forming unit 44 when the pressing roller 41 presses the nip forming unit 44 with the fixing belt 42 interposed therebetween. Hereinafter, this will be described in detail.

Figure 4:
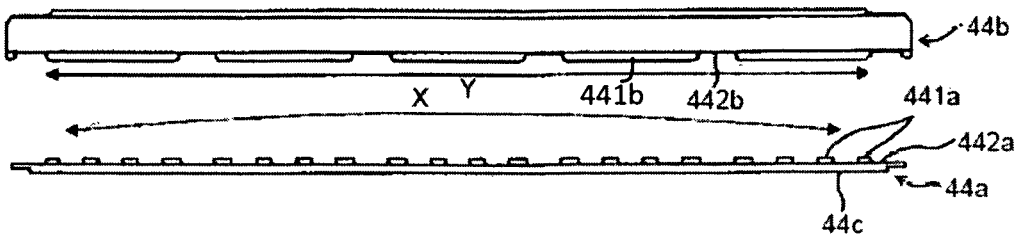
FIG. 4 is a diagram illustrating the contact member and the supporting stay of the embodiment when viewed in the recording sheet conveying direction.
Figure 5:
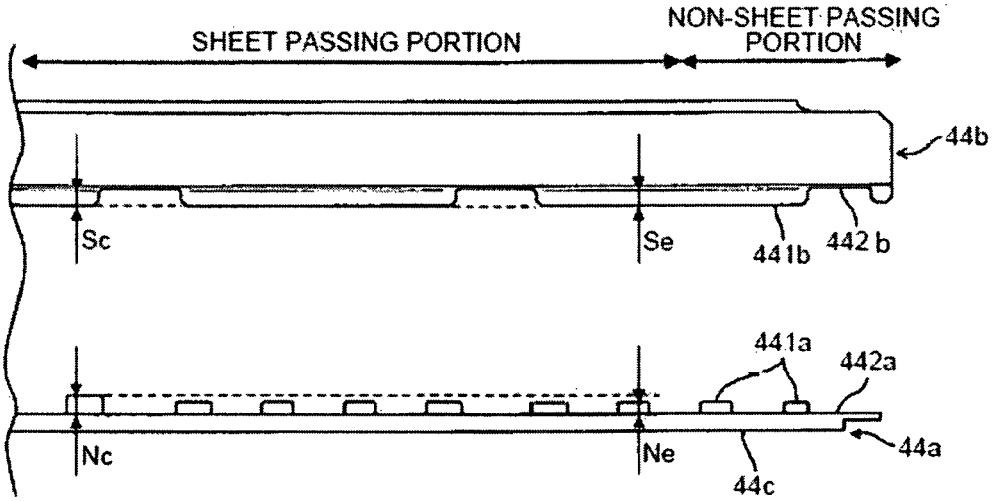
FIG. 5 is an enlarged diagram illustrating the contact member and the supporting stay within a range from the center to one end thereof in the main-scanning direction.

FIG. 4 is a diagram illustrating the contact member 44*a* and the supporting stay 44*b* of the embodiment in the recording sheet conveying direction, and FIG. 5 is an enlarged diagram illustrating the center and one end of each of the contact member 44*a* and the supporting stay 44*b* in the main-scanning direction.

As depicted by the arrow X of FIG. 4, the line which connects the apexes of the respective fixing portions 441*a* of the contact member 44*a* is formed as a quadratic curve, and the protruding amount at the center of the fixing portion 441*a* in the main-scanning direction from the stay facing surface 442*a* is set to be larger than the protruding amount at the end. On the other hand, as depicted by the arrow Y, the line which connects the apexes of the respective subject fixing portions 441*b* of the supporting stay 44*b* is formed as a linear shape.

As illustrated in FIG. 5, in the embodiment, when the protruding amount of the subject fixing portion 441*b* from the facing surface 442*b* at the center of the supporting stay 44*b* in the main-scanning direction is denoted by Sc, the protruding amount of the subject fixing portion 441*b* from the facing surface 442*b* at the end is denoted by Se, the protruding amount of the fixing portion 441*a* from the supporting stay facing surface 442*a* at the center of the contact member 44*a* in the main-scanning direction is denoted by Nc, the protruding amount of the fixing portion 441*a* from the supporting stay facing surface 442*a* at the end is denoted by Ne, and the bent amount of the nip forming unit 44 is denoted by δ, the nip forming unit 44 is formed so as to satisfy the following two conditions.

$$\delta>(Sc+Nc)-(Se+Ne) \quad 1.$$

$$(Sc+Nc)-(Se+Ne)>0 \quad 2$$

In the embodiment, as illustrated in FIG. 5, the above condition 2 is satisfied in a state where Sc=Se and Nc−Ne=0.4 (mm). Further, since the bent amount δ is about 0.5 [mm], the above condition 1 is satisfied.

Since the above conditions 1 and 2 are satisfied, when the nip forming unit 44 is pressed and bent by the pressing roller 41, the center of the contact surface 44*c* of the nip forming unit 44 (the contact member 44*a*) in the main-scanning direction is slightly curved in relation to the end thereof in a direction moving away from the pressing roller 41 (so as to have a concave shape). Accordingly, the nip pressure at the non-sheet passing portion may be made to be larger than the nip pressure at the sheet passing portion. Thus, a decrease in nip pressure at the non-sheet passing portion when the recording sheet S is conveyed to the sheet passing portion may be suppressed compared to the case where the contact surface 44*c* of the nip forming unit 44 (the contact member 44*a*) is flat when the nip forming unit 44 is pressed and bent by the pressing roller 41. Thus, even at the time when the recording sheet S is conveyed to the sheet passing portion, a sufficient rotational driving force may be transmitted from the pressing roller 41 to the non-sheet passing portion, and hence the fixing belt 42 may be suppressed from slipping and the rotation thereof may be suppressed from being stopped.

Further, in the embodiment, the nip pressures of the non-sheet passing portions at both ends of the fixing nip are about 1.2 [kgf/cm$^2$]. If the nip pressures at both ends are set to 1.2 [kgf/cm$^2$] or more, even when the recording sheet S having a smooth surface is conveyed to the fixing nip, the rotational driving force of the pressing roller may be satisfactorily transmitted to the fixing belt in the non-sheet passing portion at the end of the fixing nip in the main-scanning direction. Accordingly, slipping of the fixing belt or a sheet conveying failure can be suppressed.

Further, when there is a large difference between the nip pressure at the end and the nip pressure at the center in the main-scanning direction, the upstream portion of the recording sheet, which is conveyed to the fixing nip, in relation to the fixing nip may be corrugated, the image of the rear end of the recording sheet S may have a defect, or the rear end may be wrinkled. In the embodiment, when the nip pressure at the end in the main-scanning direction is less than about 2.2 times the nip pressure at the center, the corrugation may be suppressed. In the embodiment, the nip pressure at the center in the main-scanning direction is about 0.7 [kgf/cm$^2$], the nip pressure at the non-sheet passing portion at both ends is about 1.2 [kgf/cm$^2$], and the nip pressure at the end in the main-scanning direction is about 1.7 times the nip pressure at the center.

Further, in the embodiment, the center of the contact surface 44*c* of the nip forming unit 44 (the contact member 44*a*) in the main-scanning direction protrudes further by 0.4 [mm] than the end in no-load state. Then, since the bent amount 6 when the nip forming unit 44 is pressed and bent by the pressing roller 41 is 0.5 [mm], both ends of the contact surface 44*c* of the nip forming unit 44 in the main-scanning direction protrude further by about 0.1 [mm] than the center thereof. In this way, since the curved degree of the contact surface 44*c* of the nip forming unit when being pressed by the pressing roller 41 may be suppressed compared to the case where the contact surface 44*c* is not curved toward the pressing roller in no-load state, too much increase in a deviation of a nip width between the end and the center in the main-scanning direction may be suppressed. Further, it is desirable that the protruding amount at both ends of the contact surface 44*c* of the nip forming unit 44 in the main-scanning direction when the nip forming unit 44 is pressed and bent by the pressing roller 41 be smaller than the protruding amount at the center by 0.3 [mm] or less. When the protruding amount becomes more than 0.3 [mm], a deviation in nip width between the end and the center in the main-scanning direction increase too much, the image becomes noticeably uneven.

Figure 6:
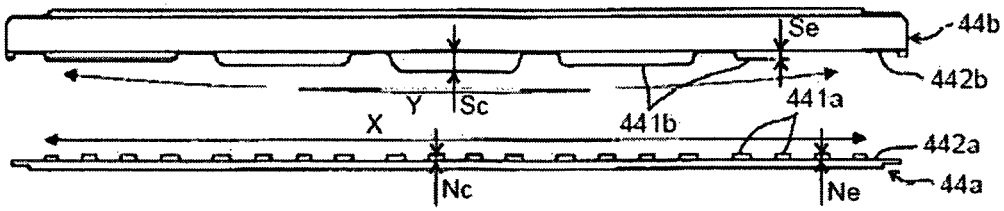
FIG. 6 is a diagram illustrating an example in which a subject fixing portion of the supporting stay is made to have different heights.

Further, in the description above, the protruding amount of the fixing portion 441*a* of the contact member 44*a* from the supporting stay facing surface 442*a* at the center in the main-scanning direction is larger than the protruding amount at the end. However, as illustrated in FIG. 6, the protruding amount of the subject fixing portion 441*b* of the supporting stay 44*b* from the facing surface 442*b* at the center in the main-scanning direction may be larger than the protruding amount at the end. In this case, when the bent amount δ=0.5 [mm], (Sc−Se)=0.4.

Figure 7A:
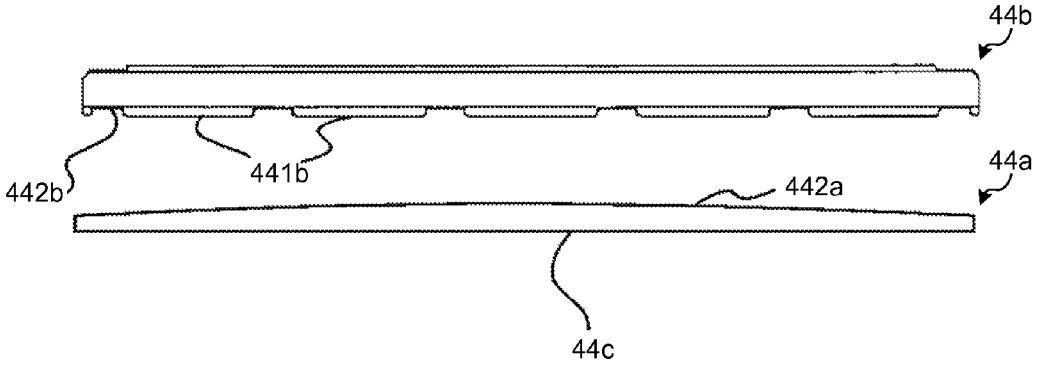
FIG. 7A is a diagram illustrating an example in which a stay facing surface of the contact member is formed as a curved surface.
Figure 7B:
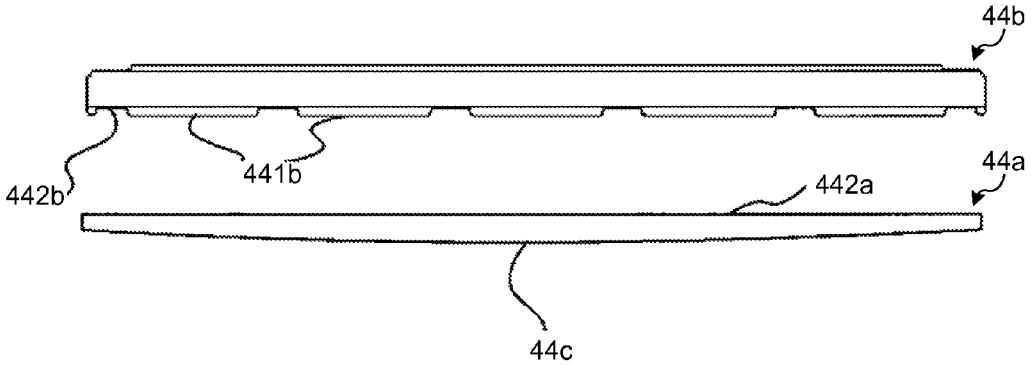
FIG. 7B is a diagram illustrating an example in which a contact surface of the contact member is formed as a curved surface.

Further, in the description above, the height of the fixing portion 441*a* from the supporting stay facing surface 442*a* is adjusted by forming the fixing portion 441*a* which protrudes from the supporting stay facing surface 442*a* of the contact member 44*a*. However, as illustrated in FIG. 7A, the supporting stay facing surface 442*a* of the contact member 44*a* may be formed as a curved surface of which the center in the main-scanning direction protrudes toward the supporting stay in relation to the end. Further, conversely, as illustrated in FIG. 7B, the contact surface 44*c* of the contact member 44*a* may be formed as a curved surface of which the center in the main-scanning direction protrudes toward the pressing roller in relation to the end.

Further, although the facing surface 442*b* of the supporting stay 44*b* which faces the contact member 44*a* may be formed as a curved surface, it is difficult to process the curved surface. That is, since the supporting stay 44*b* is used to reinforce and support the contact member 44*a*, it needs a certain degree of strength. Thus, in order to ensure the strength, stainless steel (SUS) with a thickness of 3 [mm] or more is desirable. In this way, since the supporting stay 44*b* is metal with a certain degree of thickness, it is difficult to process the facing surface 442*b* into a curved surface by a pressing process in consideration of the dimensional precision, and hence it is formed by a cutting process. In this case, when the facing surface 442*b* which faces the contact member 44*a* changes like a curve, it is slightly difficult to process the shape of the portion.

On the other hand, the contact member 44*a* may be formed as an elastic member capable of following the minute unevenness of the toner image of the recording sheet S which is conveyed to the fixing nip, and the elastic member may be formed of resin, rubber, or the like. Since the resin or the rubber may form the elastic member by an injection molding process or the like, when a mold with high precision is manufactured once, the mold may form a curved surface with high precision later on. Thus, it is desirable that the contact member 44*a* have a curved surface in that manufacturing cost may be decreased.

Figure 8:
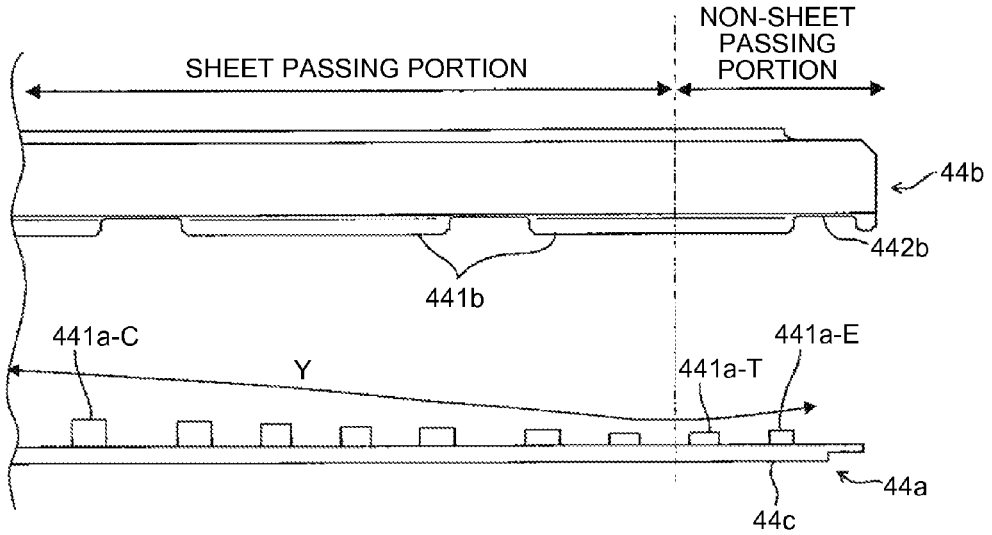
FIG. 8 is a diagram illustrating an example in which a fixing portion at an end of the contact member in the main-scanning direction is made to be higher than a fixing portion at an end of a sheet passing portion.

Further, as illustrated in FIG. 8, the protruding amount of a fixing portion 441*a*-E from the stay facing surface 442*a* at the end of the contact member 44*a* in the main-scanning direction may be larger than the protruding amount of a fixing portion 441*a*-T from the stay facing surface 442*a* at the end of the sheet passing portion. Accordingly, the nip pressure at the non-sheet passing portion may be further increased, and a sufficient rotational driving force is transmitted from the pressing roller 41 in the non-sheet passing portion, thereby suppressing the fixing belt 42 from slipping or the rotation thereof from being stopped. Furthermore, when the fixing portion 441*a*-E at the end in the main-scanning direction protrudes too much in relation to the fixing portion 441*a*-T at the end of the sheet passing portion, there is a possibility that the nip pressure at the end of the sheet passing portion may be decreased or a fixing failure may occur in the toner image of the recording sheet passing through the end of the sheet passing portion. For this reason, it is desirable that the protruding amount of the fixing portion 441*a*-E at the end in the main-scanning direction be smaller than the protruding amount of the fixing portion 441*a*-T at the end of the sheet passing portion by 0.3 [mm] or less.

Figure 9A:
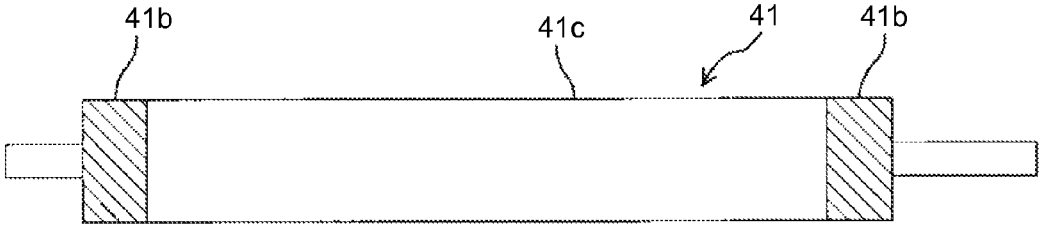
FIG. 9A is a diagram illustrating an example in which an elastic layer is exposed in a non-sheet passing portion of a pressing roller.

Further, as described above, since the pressing roller 41 needs a separating property due to paper and toner passing thereon, the separation layer is formed on the outer surface of the elastic layer 41*b*. However, since neither paper nor toner passes through the non-sheet passing portion, the separation layer is not particularly needed at that portion. For this reason, in the configuration in which the driving force is transmitted from the pressing roller 41 to the fixing belt 42, it is desirable that the non-sheet passing portion be formed of a material with friction higher than that of the separation layer. As a simple configuration, as illustrated in FIG. 9A, both ends of the pressing roller 41 corresponding to the non-sheet passing portion are not provided with a separation layer 41*c*, and the elastic layer 41*b* formed of silicon rubber is exposed to the surface. Further, a high-friction member may be coated on the separation layer 41*c* of the non-sheet passing portion. However, in this case, cost increases compared to the case where the elastic layer 41*b* is exposed. Further, since the outer diameter of the pressing roller 41 increases as much as the thickness of the high-friction member, the sheet conveying amount during the fixing operation increases, which is disadvantageous in the fixing operation. Specifically, when the diameter of the pressing roller of a position (both ends) with a high-friction member is set to 30.5 [mm] and the diameter of the other position (the center) is set to 30 [mm], the sheet conveying amount is 30.5 [mm] in both the end and the center per one revolution of the roller. However, since the diameter at the center is 30 [mm], the sheet may be sent only by 30 [mm] even when the pressing roller 41 rotates once. That is, the center rotates slower than the speed at which the recording sheet advances (so that slight slipping occurs). As a result, there is concern that a defective image may be obtained or the recording sheet may be corrugated.

In this way, since the friction coefficient of the non-sheet passing portion of the pressing roller 41 is set to be larger than the friction coefficient of the sheet passing portion, the rotational driving force may be satisfactorily transmitted to the fixing belt 42 in the non-sheet passing portion, and hence the fixing belt 42 may be stably rotated.

Figure 9B:
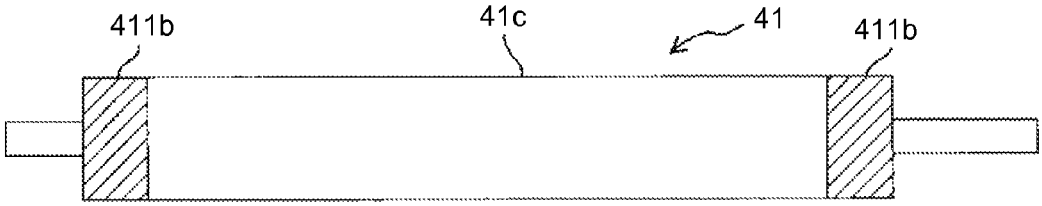
FIG. 9B is a diagram in which a high-hardness member is used in an end.

Further, as illustrated in FIG. 9B, the hardness of an elastic layer 411*b* of the non-sheet passing portion of the pressing roller 41 may be set to be higher than the hardness of the elastic layer of the sheet passing portion by forming the elastic layer at both ends as the non-sheet passing portion of the pressing roller 41 and the elastic layer at the center as the sheet passing portion of the pressing roller 41 from different materials. The elastic layer of the sheet passing portion is formed of a rubber material of 5° in Asker A, and the end is formed of a rubber material of about 15°. When the hardness of the rubber of the non-sheet passing portion increases, the nip pressure at the non-sheet passing portion may increase. Accordingly, the rotational driving force may be satisfactorily transmitted to the fixing belt 42 in the non-sheet passing portion, and hence the fixing belt 42 may be stably rotated. Further, FIG. 9B illustrates a configuration in which the elastic layer 411*b* of the non-sheet passing portion is exposed. However, a configuration may be used in which the elastic layer 411*b* of the non-sheet passing portion is coated by the separation layer 41*c*.

Further, the embodiment may be applied to a configuration in which the driving force is transmitted from the pressing roller 41 to the fixing belt 42 in the fixing nip. Further, in the embodiment, the pressing member is a roller member, but the pressing member may be a pressing belt which is suspended on plural rollers.

As described above, according to the fixing device 4 of the embodiment, the fixing device includes: the fixing belt 42 which serves as an endless fixing member; the heating unit 43 which is disposed inside of the inner peripheral surface of the fixing belt 42 and heats the fixing belt 42; and the nip forming unit 44 which is disposed inside of the inner peripheral surface of the fixing belt 42 and comes into press-contact with the rotationally driven pressing roller 41 as the pressing member with the fixing belt interposed therebetween so as to form a nip to which the recording sheet S is conveyed. With regard to the nip forming unit 44, both ends in the width direction of the recording sheet S (the main-scanning direction) are fixed and supported. Then, the protruding amount at the center in the recording sheet width direction of the contact surface 44*c* of the nip forming unit 44 toward the pressing roller in relation to both ends in no-load state is set to be less than the bent amount of the nip forming unit 44 when the nip forming unit 44 comes into press-contact with the pressing roller 41 with the fixing belt 42 interposed therebetween. Accordingly, as described above, the slipping of the fixing belt or the conveying failure of the recording sheet may be suppressed. Further, it is possible to prevent the image of the recording sheet from being corrugated or unevenly formed.

Further, the nip forming unit 44 includes the supporting stay 44*b* which serves as the supporting member having both fixed and supported ends in the main-scanning direction and the contact member 44*a* which is fixed to the supporting stay 44*b* and comes into contact with the pressing roller 41 with the fixing belt 42 interposed therebetween. Then, the height of the fixing portion 441*a* of the contact member 44*a* which is fixed to the supporting stay 44*b* is made to be even in the main-scanning direction. Further, the center of the subject fixing portion 441*b* in the main-scanning direction of the supporting stay 44*b* to which the contact member 44*a* is fixed protrudes further toward the pressing roller than both ends in no-load state. With such a configuration, when the contact member 44*a* is fixed to the supporting stay 44*b*, the center of the contact surface 44*c* of the nip forming unit 44 in the main-scanning direction may protrude further than the end. Further, the length of the contact member 44*a* in the direction perpendicular to the recording sheet is made to be even in the main-scanning direction, thereby forming the fixing portion 441*a* of the contact member 44*a* by a simple process compared to the case where the length of the contact member 44*a* in the direction perpendicular to the recording sheet is made to be different.

Further, on the contrary, the height of the subject fixing portion 441*b* serving as the fixing portion of the supporting stay 44*b* to which the contact member 44*a* is fixed is made even in the width direction; and the length at the center of the contact member 44*a* in the main-scanning direction in the direction perpendicular to the recording sheet may be longer than the lengths at both ends. Even in such a configuration, when the contact member 44*a* is fixed to the supporting stay 44*b*, the center of the contact surface 44*c* of the nip forming unit 44 in the main-scanning direction may protrude further than the end. Further, the height of the subject fixing portion 441*b* of the supporting stay 44*b* is made to be even, thereby forming the fixing portion 441*a* of the contact member 44*a* by a simple process compared to the case where the height of the subject fixing portion 441*b* is made to be different.

Further, when the nip forming unit 44 comes into press-contact with the rotationally driven pressing roller 41 with the fixing belt 42 interposed therebetween, the nip pressure at both ends of the fixing nip in the main-scanning direction is set to be higher than the nip pressure at the center. Accordingly, the rotational driving force transmitted to the fixing belt at the non-sheet passing portion serving as both ends of the fixing nip may be increased, and hence the fixing belt 42 may be stably rotated.

Further, since the nip pressure at both ends in the main-scanning direction is set to 1.2 [kgf/cm$^2$] or more, the rotational driving force transmitted to the fixing belt at the non-sheet passing portion serving as both ends of the fixing nip may be increased, and hence the fixing belt 42 may be stably rotated.

Further, since the friction coefficients of the surfaces at both ends of the pressing roller 41 in the main-scanning direction are set to be higher than the friction coefficient at the center, the rotational driving force transmitted to the fixing belt in the non-sheet passing portion may be increased, and hence the fixing belt 42 may be stably rotated. As an example, the elastic layer is exposed in a part of the surfaces at both ends in the main-scanning direction. Accordingly, the friction coefficients of the surfaces at both ends in the main-scanning direction may be made to be higher than the friction coefficient at the center compared to the configuration in which the high-friction member is coated on both ends of the pressing roller 41 in the main-scanning direction.

Further, the pressing roller 41 includes the elastic layer 41*b*, and the hardness of the elastic layers 41*b* at both ends of the pressing roller 41 are set to be higher than the hardness at the center, which may increase the nip pressure at the non-sheet passing portion as both ends of the fixing nip. Accordingly, the rotational driving force which is transmitted to the fixing belt in the non-sheet passing portion as both ends of the fixing nip may be increased, and hence the fixing belt 42 may be stably rotated.

Further, the printer which is the image forming apparatus of the embodiment may obtain a satisfactory image without any defect by equipping with the above-described fixing device 4. Further, the printer may stably perform a printing process avoiding occurrence of a paper jam.

According to the embodiment, since the center of the contact surface of the nip forming unit in the recording sheet width direction protrudes toward the pressing member compared to both ends in no-load state, occurrence of the curved contact surface of the nip forming unit may be avoided when the nip forming unit is bent compared to the fixing device in which the contact surface of the nip forming unit is flat in no-load state. As a result, occurrence of an uneven image may be avoided by reducing a deviation between the end and the center of the nip width in the main-scanning direction compared to the fixing device in which the contact surface of the nip forming unit is flat in no-load state.

Further, the protruding amount at the center in the recording sheet width direction of the contact surface of the nip forming unit toward the pressing member in relation to both ends in no-load state is set to be less than the bent amount of the nip forming unit. Accordingly, when the nip forming unit is bent by the pressure of the pressing member, the contact surface of the nip forming unit is not flat and the center thereof in the recording sheet width direction is slightly curved in a direction moving away from the pressing member when seen from the recording sheet conveying direction, unlike the fixing device which is disclosed in Japanese Patent Application Laid-open No. 2010-096782. As a result, the contact pressure between the non-sheet passing portion of the fixing member and the pressing member when the recording sheet is conveyed to the fixing nip may be set to be higher than that of the fixing device which is disclosed in Japanese Patent Application Laid-open No. 2010-096782 in which the contact surface of the nip forming unit is flat in a state where the nip forming unit is bent by the pressure of the pressing member. Thus, even when the recording sheet having a smooth surface is conveyed to the fixing nip, a sufficient rotational driving force is transmitted from the pressing member to the fixing member at the non-sheet passing portions at both ends. Accordingly, slipping or stopping of the fixing member can be avoided, and occurrence of a defective image or a conveying failure of the recording sheet can be avoided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

an endless fixing member;

a heating unit that is provided inside an inner peripheral surface of the fixing member that heats the fixing member; and a nip forming unit including a contact member and a supporting stay, the contact member including a plurality of first protrusions protruding toward the supporting stay, the supporting stay configured to force the contact member toward a rotationally driven pressing member, when the contact member comes into press-contact with the pressing member with the fixing member interposed therebetween during a load state so as to form a nip to which a recording sheet is conveyed, wherein a toner image on the recording sheet conveyed to the nip is fixed to the recording sheet, and a size of the plurality of first protrusions are set such that a center of the contact member protrudes a protruding amount, in the recording sheet width direction, toward the pressing member as compared to both ends of the contact member in a no-load state, the protruding amount being less than a bent amount of the contact member when the nip forming unit comes into press-contact with the pressing member with the fixing member interposed therebetween during the load state.

2. The fixing device according to claim 1, wherein a length of the contact member in a direction perpendicular to a surface of the recording sheet is even in the recording sheet width direction, and a center, in the recording sheet width direction, of a fixing portion of the supporting stay to which the contact member is fixed protrudes toward the pressing member compared to both ends in the recording sheet width direction in no-load state.

3. The fixing device according to claim 2, wherein the plurality of first protrusions protruding from the contact member toward the supporting stay have a height Nc in the center of the fixing portion and a height Ne at the both ends, the supporting stay has a plurality of second protrusions protruding therefrom toward the contact member with a height Sc in the center of the fixing portion and a height Se at the both ends, the bent amount during the press-contact is greater than (Sc+Nc)−(Se+Ne), where (Sc+Nc)−(Se+Ne) is greater than zero.

4. The fixing device according to claim 1, wherein the supporting stay is supported by the heating unit in the recording sheet width direction, the contact member is fixed to the supporting stay and comes into contact with the pressing member with the fixing member interposed therebetween, a height of a fixing portion of the supporting stay to which the contact member is fixed is even in the width direction, and a length at the center of the contact member in the recording sheet width direction, the length being a length in a direction perpendicular to the surface of the recording sheet, is longer than a length at both ends in the recording sheet width direction.

5. The fixing device according to claim 1, wherein when the nip forming unit comes into press-contact with the rotationally driven pressing member with the fixing member interposed therebetween, nip pressures at both ends of the nip are set to be higher than a nip pressure at the center.

6. The fixing device according to claim 5, wherein the nip pressures at both ends in the recording sheet width direction are set to 1.2 [kgf/cm$^2$] or more.

7. The fixing device according to claim 1, wherein friction coefficients of surfaces at both ends of the pressing member in the recording sheet width direction are set to be higher than a friction coefficient at the center.

8. The fixing device according to claim 7, wherein the pressing member includes an elastic layer, and the elastic layer at least partially is exposed at a part of the surface at both ends of the pressing member in the recording sheet width direction.

9. The fixing device according to claim 1, wherein the pressing member includes elastic layer, and a hardness of the elastic layer at both ends of the pressing member in the recording sheet width direction is set to be higher than a hardness at the center.

10. The fixing device according to claim 1, wherein the plurality of first protrusions of the contact member facing the supporting stay are arranged in the recording sheet width direction, the plurality of first protrusions connecting the contact member and the supporting stay, the contact member configured to come into contact with the pressing member with the fixing member interposed therebetween.

11. The fixing device according to claim 1, wherein the supporting stay has two ends in the recording sheet width direction and a facing surface facing the contact member, the two ends being supported by the fixing device, the facing surface including a plurality of second protrusions protruding therefrom, the plurality of second protrusions connecting the supporting stay and the contact member.

12. The fixing device according to claim 1, wherein the heating unit includes a heater.

13. The fixing device according to claim 1, wherein the heating unit includes a heater and a pipe.

14. The fixing device according to claim 1 wherein the nip forming unit is configured such that, the center of the contact member protrudes the protruding amount towards the pressing member when the nip forming unit is separated from the pressing member, and the center of the contact member bends the bent amount away from the pressing member when the nip forming unit is in the press-contact with the pressing member, the bent amount during the press-contact being greater than the protruding amount when the nip forming unit is separated from the pressing member.

15. The fixing device according to claim 1, wherein the supporting stay has a plurality of second protrusions protruding therefrom toward the contact member such that the plurality of second protrusions correspond to the plurality of first protrusions, and a size of the plurality of second protrusions being such that the center of the contact member protrudes the protruding amount, in the recording sheet width direction, toward the pressing member as compared to both ends of the contact member in the no-load state, the protruding amount being less than the bent amount of the contact member when the nip forming unit comes into press-contact with the pressing member with the fixing member interposed therebetween.

16. The fixing device according to claim 1, wherein the supporting stay has a plurality of second protrusions protruding therefrom toward the contact member such that the plurality of second protrusions correspond to the plurality of first protrusions, the contact member is provided parallel to the recording sheet width direction and the supporting stay is provided perpendicular thereto such that both of two ends of the contact member in the recording sheet width direction are supported by the supporting stay, and in response to the press-contact forcing the contact member toward the supporting stay, the plurality of second protrusions of the supporting stay are configured to force the plurality of first protrusions of the contact member back toward the pressing member such that an amount of the force applied against the pressing member by both of the two ends of the contact member is greater than an amount of the force applied by the center of the contact member.

17. An image forming apparatus comprising:

the toner image forming unit that forms a toner image on the recording sheet; and the fixing device according to claim 1, the fixing device configured to fix the toner image formed on the recording sheet onto a recording sheet.

18. A fixing device comprising:

an endless fixing member;

a heating unit that is provided inside an inner peripheral surface of the fixing member that heats the fixing member; and a nip forming unit including a contact member and a supporting stay, the supporting stay including a plurality of first protrusions protruding toward the contact member, the supporting stay configured to force the contact member toward a rotationally driven pressing member, when the contact member comes into press-contact with the pressing member with the fixing member interposed therebetween during a load state so as to form a nip to which a recording sheet is conveyed, wherein a toner image on the recording sheet conveyed to the nip is fixed to the recording sheet, and a size of the plurality of first protrusions are set such that a center of the contact member protrudes a protruding amount, in the recording sheet width direction, toward the pressing member as compared to both ends of the contact member in a no-load state, the protruding amount being less than a bent amount of the contact member when the nip forming unit comes into press-contact with the pressing member with the fixing member interposed therebetween during the load state.

19. The fixing device according to claim 18, wherein a length of the contact member in a direction perpendicular to a surface of the recording sheet is even in the recording sheet width direction, and a center, in the recording sheet width direction, of a fixing portion of the supporting stay to which the contact member is fixed protrudes toward the pressing member compared to both ends in the recording sheet width direction in no-load state.

20. The fixing device according to claim 19, wherein the plurality of first protrusions protruding from the supporting stay toward the contact member have a height Sc in the center of the fixing portion and a height Se at the both ends, the contact member has a plurality of second protrusions protruding therefrom toward the contact member with a height Nc in the center of the fixing portion and a height Ne at the both ends, the bent amount during the press-contact is greater than (Sc+Nc)−(Se+Ne), where (Sc+Nc)−(Se+Ne) is greater than zero.

21. The fixing device according to claim 18, wherein the supporting stay is supported by the heating unit in the recording sheet width direction, the contact member is fixed to the supporting stay and comes into contact with the pressing member with the fixing member interposed therebetween, a height of a fixing portion of the supporting stay to which the contact member is fixed is even in the width direction, and a length at the center of the contact member in the recording sheet width direction, the length being a length in a direction perpendicular to the surface of the recording sheet, is longer than a length at both ends in the recording sheet width direction.

22. The fixing device according to claim 18, wherein when the nip forming unit comes into press-contact with the rotationally driven pressing member with the fixing member interposed therebetween, nip pressures at both ends of the nip are set to be higher than a nip pressure at the center.

23. The fixing device according to claim 22, wherein the nip pressures at both ends in the record sheet width direction are set to 1.2 [kgf/cm$^2$] or more.

24. The fixing device according to claim 18, wherein friction coefficients of surfaces at both ends of the pressing member in the recording sheet width direction are set to be higher than a friction coefficient at the center.

25. The fixing device according to claim 24, wherein the pressing member includes an elastic layer, and the elastic layer at least partially is exposed at a part of the surface at both ends of the pressing member in the recording sheet width direction.

26. The fixing device according to claim 18, wherein the pressing member includes elastic layer, and a hardness of the elastic layer at both ends of the pressing member in the recording sheet width direction is set to be higher than a hardness at the center.

27. The fixing device according to claim 18, wherein the plurality of first protrusions of the supporting stay facing the contact member are arranged in the recording sheet width direction, the plurality of first protrusions connecting the supporting stay and the contact member, the contact member configured to come into contact with the pressing member with the fixing member interposed therebetween.

28. The fixing device according to claim 18, wherein the supporting stay has two ends in the recording sheet width direction and a facing surface facing the contact member, the two ends being supported by the fixing device, the facing surface including the plurality of first protrusions protruding therefrom, the plurality of first protrusions connecting the supporting stay and the contact member.

29. The fixing device according to claim 18, wherein the heating unit includes a heater.

30. The fixing device according to claim 18, wherein the heating unit includes a heater and a pipe.

31. The fixing device according to claim 18, wherein the nip forming unit is configured such that, the center of the contact member protrudes the protruding amount towards the pressing member when the nip forming unit is separated from the pressing member, and the center of the contact member bends the bent amount away from the pressing member when the nip forming unit is in the press-contact with the pressing member, the bent amount during the press-contact being greater than the protruding amount when the nip forming unit is separated from the pressing member.

32. The fixing device according to claim 18, wherein the contact member has a plurality of second protrusions protruding therefrom toward the supporting stay such that the plurality of second protrusions correspond to the plurality of first protrusions, and a size of the plurality of second protrusions being such that the center of the contact member protrudes the protruding amount, in the recording sheet width direction, toward the pressing member as compared to both ends of the contact member in the no-load state, the protruding amount being less than the bent amount of the contact member when the nip forming unit comes into press-contact with the pressing member with the fixing member interposed therebetween.

33. The fixing device according to claim 18, wherein the contact member has a plurality of second protrusions protruding therefrom toward the supporting stay such that the plurality of second protrusions correspond to the plurality of first protrusions, the contact member is provided parallel to the recording sheet width direction and the supporting stay is provided perpendicular thereto such that both of two ends of the contact member in the recording sheet width direction are supported by the supporting stay, and in response to the press-contact forcing the contact member toward the supporting stay, the plurality of first protrusions of the supporting stay are configured to force the plurality of second protrusions of the contact member back toward the pressing member such that an amount of the force applied against the pressing member by both of the two ends of the contact member is greater than an amount of the force applied by the center of the contact member.

34. An image forming apparatus comprising:

a toner image forming unit that forms the toner image on the recording sheet; and the fixing device according to claim 18, the fixing device configured to fix the toner image formed on the recording sheet.

* * * * *